United States Patent [19]

Kageyama et al.

[11] Patent Number: 4,856,693

[45] Date of Patent: Aug. 15, 1989

[54] WORKING OUT CONTAINER OF BAR SHAPED ARTICLE

[75] Inventors: Shuhei Kageyama; Tadashi Yamamoto; Tadayoshi Ebinuma, all of Kawagoeshi, Japan

[73] Assignee: Kotobuki and Company, Ltd., Tokyo, Japan

[21] Appl. No.: 159,258

[22] Filed: Feb. 23, 1988

[30] Foreign Application Priority Data

| | | | |
|---|---|---|---|
| Feb. 23, 1987 | [JP] | Japan | 62-26097[U] |
| Apr. 28, 1987 | [JP] | Japan | 62-65560[U] |
| Jul. 14, 1987 | [JP] | Japan | 62-108497[U] |

[51] Int. Cl.[4] ..... B43K 24/12; B43K 24/18

[52] U.S. Cl. ..... 226/127; 401/65; 401/80; 401/94; 279/43; 279/46 A; 15/433

[58] Field of Search ..... 401/65, 67, 80, 92–94, 401/117, 53; 15/424–433; 226/127–129; 82/2.5; 279/23, 41, 43, 46 A, 102

[56] References Cited

U.S. PATENT DOCUMENTS

| | | | |
|---|---|---|---|
| 223,467 | 1/1880 | Benson | 401/94 |
| 240,399 | 4/1881 | Frederick | 401/94 |
| 253,803 | 2/1882 | Wittmann | 401/67 |
| 271,439 | 1/1883 | Eybel | 401/67 |
| 372,710 | 11/1887 | Schrader | 401/53 |
| 1,702,780 | 2/1929 | Ingersoll | 401/67 |
| 2,275,055 | 3/1942 | Watzlawik | 401/53 |
| 2,358,091 | 9/1944 | Lovejoy | 401/65 |
| 2,509,849 | 5/1950 | Von Allmen | 401/67 |
| 4,219,282 | 8/1980 | Kuo | 401/94 X |

*Primary Examiner*—Richard J. Apley
*Assistant Examiner*—David J. Bender
*Attorney, Agent, or Firm*—Donald D. Mon; David O'Reilly

[57] ABSTRACT

This invention relates to a container for feeding a bar shaped article such as an erasing gum, a pencil lead, a crayon, a pastel, or an eyebrow stick, especially for advancing or retracting the bar shaped article. A bar shaped article (8) is inserted into an inner sleeve (2) from the rear end with the outer sleeve (1) being held by the hand, then the rear end of the inner sleeve (2) is pressed. Inner sleeve (2) moves forward and rearward against the resilient force of an elastic biasing member (3). A chuck (4) at the end of the inner sleeve (2) opens and closes repeatedly and the end of the bar shaped article (8) is fed out and can be used. When the chuck (4) holds the bar shaped article (8) in an unused state a chuck open means opens the chuck 4 slightly and loosens the securing force preventing encroachment of the chuck (4) into the article (8) allowing the chuck (4) to easily separate from the article (8) when the article (8) is fed out. Therefore feeding of the article (8) is performed accurately and smoothly.

2 Claims, 11 Drawing Sheets

WORKING OUT CONTAINER OF BAR SHAPED ARTICLE

FIELD OF THE INVENTION

This invention relates to a container for extending a bar shaped article such as an erasing gum, a pencil lead, a crayon, a pastel, or an eyebrow liner, for example, especially for extending or retracting the bar shaped article.

BACKGROUND OF THE INVENTION

Heretofore, devices for exposing a bar-shaped erasing gum, crayon, or pastel, comprise an outer paper wrapper or outer core on them which is scraped away a small amount with a knife exposing an end of the article for use.

However, scraping away the paper or outer core is troublesome and excess scraping might occur. After exposing the bar shaped article, a cap is then required to protect the end of the bar shaped article and prevent contamination of the end, but removing and replacing the cap is troublesome.

Moreover, bar shaped articles such as erasing gum are often soft and pliant so that in non-use, they can be distorted by the securing force of a chuck holding them, and if the duration of time from manufacturer to consumer is long, the chuck encroaches into the article and can not be separated from the article, making it difficult to expose the article.

BRIEF DESCRIPTION OF THE INVENTION

This invention intends to eliminate such drawbacks, and an object of this invention is to provide a container for extending a bar shaped article in which the end of the bar shaped article can be extended from the container and retracted into the container after use by a physical tap.

Another object of this invention is to provide a container for extending a bar shaped article in which a chuck opens slightly during non-use by an amount which comfortably retain an article such an eraser.

The above and other objects, advantages and novel features of this invention will be more fully understood from the following detailed description and the accompanying drawings, in which like reference numbers indicate like or similar parts throughout, wherein;

DETAILED DESCRIPTION OF THE INVENTION

Figure 1:
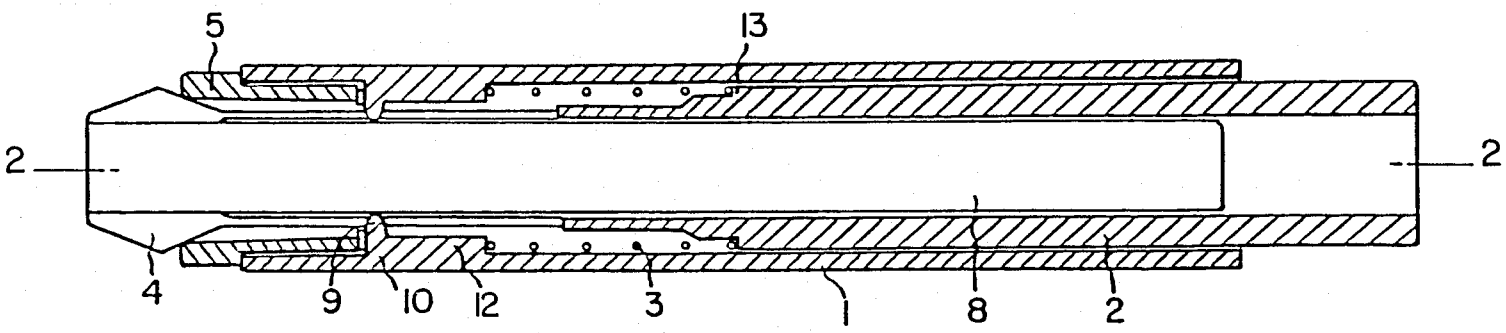
FIG. 1 shows a cross sectional view of the article container of an embodiment of this invention.
Figure 2:
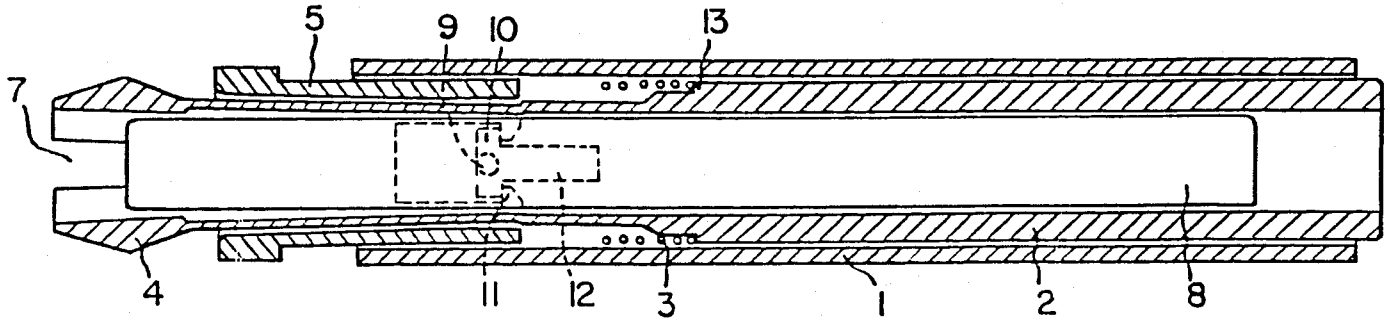
FIG. 2 shows a cross sectional view cut along line 11—11 of FIG. 1 in an extended state.

Referring to the drawings, FIG. 1 shows a cross-sectional view of a container according to one embodiment of this invention while FIG. 2 shows a cross-sectional view cut along line II—II of FIG. 1 in an extended position.

In FIGS. 1 and 2 an inner sleeve 2 is inserted in outer sleeve 1. Chuck 4 is provided at the end of inner sleeve 2. In this example, chuck 4 is formed by two divided pieces but may be three divided pieces shown in FIG. 3 a split end 7 is provided in chuck 4.

Chuck ring 5 engages the end of outer sleeve 1 and is inserted between chuck 4 and outer sleeve 1. Connecting holes 6 (FIG. 4) are provided at the opposite sides and the rear part of chuck ring 5. Projection 9 and insert 10 are provided on outer sleeve 1 at the part opposing connecting hole 6 and split end 7 of chuck 4. Insert 10 is slidably connected in connecting hole 6.

Figure 4B:
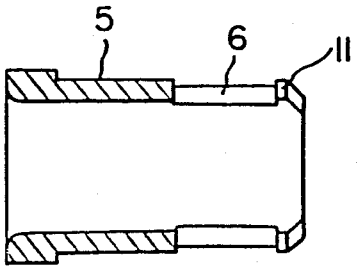
FIG. 4*b* shows a cross-sectional view cut along line IV—IV of FIG. 4*a*.
Figure 4A:
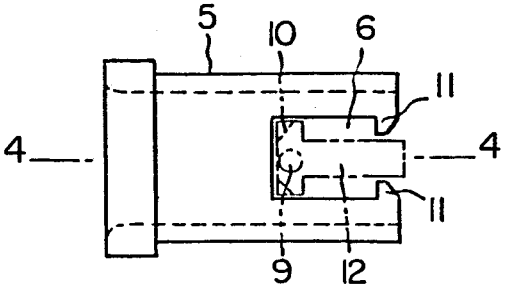
FIG. 4*a* shows a cross-sectional view of a chuck ring according to this invention.

As shown in FIG. 4 stop 11 prevents the escape of insert 10 from connecting hole 6 when connected. Stop 11 has angled edges to guide insert 10 into connecting hole 6. Insert 10 also has angled edges to ease installation in connecting hole 6.

Figure 5:
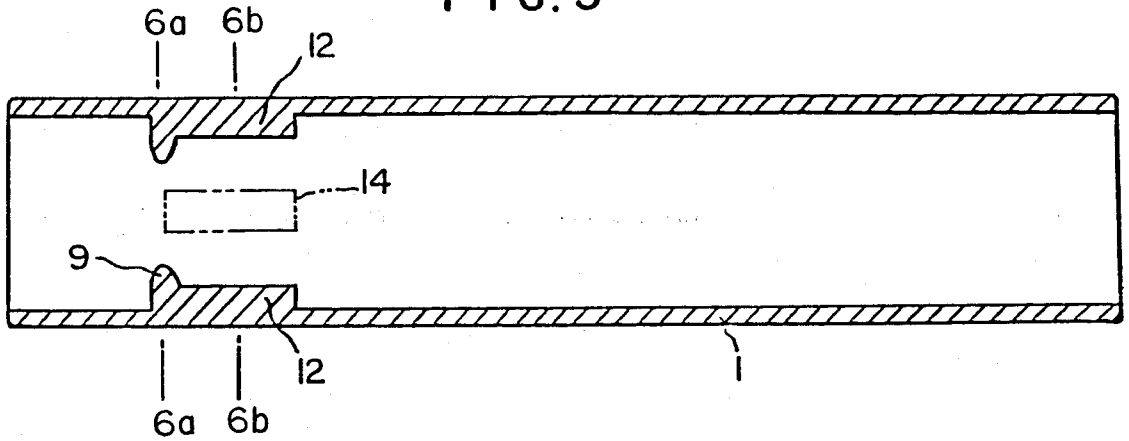
FIG. 5 shows a cross-sectional view of an outer sleeve according to another embodiment of this invention.
Figure 6B:
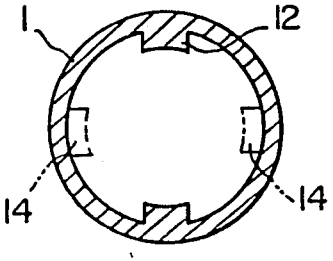
FIGS. 6*a*, and 6*b* are cross-sectional views cut along lines VI*a*—VI*a* and VI*b*, VI*b* of FIG. 5 respectively.
Figure 6A:
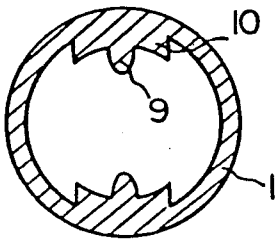

Elastic member 3 (FIG. 1) acting in an axial direction is provided between inner sleeve 2 and outer sleeve 1. In this embodiment, elastic member 3 is a thrusting spring installed between receiving abutment 13 on inner sleeve 2 and receiver 12 of insert 10 in outer sleeve 1. If receiver 12 of insert 10 is not sufficient, a ring plate or additional receivers 14,14 as shown in FIGS. 5 and 6*b* in dotted line are provided. Receivers 14,14 are at a right angle position to receivers 12,12. In this case chuck ring 5 has slits at positions corresponding to receivers 14,14.

In this embodiment, an erasing gum, a pencil lead, a crayon, a pastel, or an eyebrow liner is used as bar shaped article 8. Article 8 is inserted into sleeve 2 from the rear or front end until the end of article 8 makes contact with projection 9.

Loading article 8 in place is completed as explained but if the loading is troublesome, a placement container may be used.

For extending article 8, outer sleeve 1 is held by the hand and the rear end of inner sleeve 2 is pressed against thrust spring 3, chuck and article 8 are advanced a predetermined amount and also advancing chuck ring 5 until stop 11 of connecting hole 6 abuts insert 10 causing chuck 4 to open. In this position, projection 9 engages and holds article 8 in the position shown to prevent escape and retraction.

Next, inner sleeve 2 retracts by the resilient force of thrust spring 3 until chuck ring 5 is in contact with the end of outer sleeve 1. Then, chuck 4 retracts into chuck ring 5 and closes holding article 8 in place with projection 9.

By repeating the pressing operation, article 8 can be advanced out for use.

When the end of article 8 is worn out, it is removed by repeatedly pressing the end of inner sleeve 2.

For retracting article 8 the rear end of sleeve 2 is pressed by an amount which is more than the normal force against resilient member 3, fully opening chuck 4. The end of article 8 is then pressed against the frictional force of projection 9 engaging the article through connecting hole 6 and split end 7, to retract it into the container.

When article 8 is completely consumed, a new article 8 is supplied. Otherwise, another container may be used.

Figure 7:
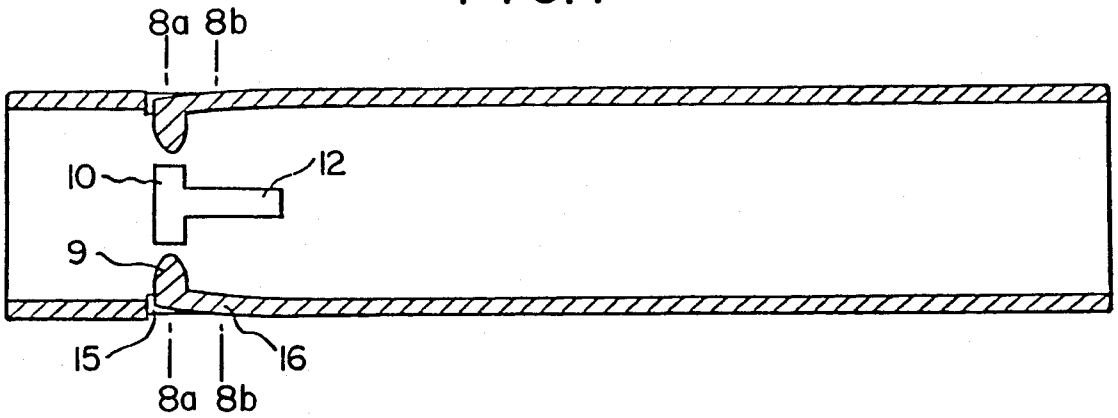
FIG. 7 shows cross-sectional view of the outer sleeve according to the second embodiment of this invention.
Figure 8B:
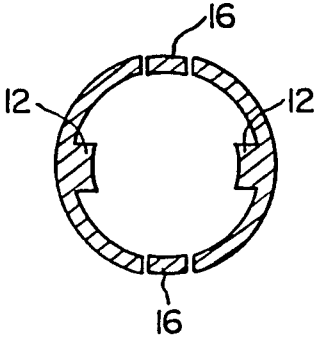
FIGS. 8*a* and 8*b* are cross-sectional views along lines VIII*a*—VIII*a* and VIII*b*, VII*b* of FIG. 7, respectively.
Figure 8A:
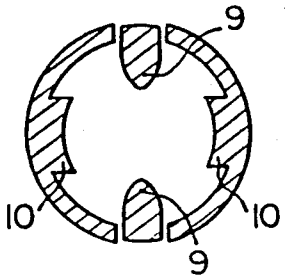

FIG. 7 shows an outer sleeve of another embodiment of this invention. FIGS. 8*a*,8*b* are cross-sectional views along lines VIII*a*—VIII*a* and VIII*b*—VIII*b* respectively.

In this embodiment, U shaped slits 15,15 are provided on outer sleeve 1 and resilient tongues 16,16 are formed and projections 9,9 are provided at the ends of the inner face of tongues 16,16. Inserts 10,10 having receiver 12 are positioned at a right angle to tongues 16,16. In this case, chuck ring 5 should have slits at a position corresponding to projection 9,9 and connecting holes 6,6 and slits a positions corresponding to insert 10,10 and receivers 12,12.

In the embodiment shown in FIG. 7, projections 9,9 are flexed by displacement of tongues 16,16 so that forwarding or retracting movement of article 8 is smoothly performed and variations in the diameter of the article 8 can be absorbed.

As explained above, in this invention, bar shaped article 8 inserted in inner sleeve 2 can be extended or fed by a predetermined amount by repeatedly pressing the rear end of inner sleeve 2 to open or close chuck 4, and may be retracted by pressing the end of article 8 with chuck 4 open. Thus, this invention provides a compact and good handling container for extending and feeding a bar shaped article.

Moreover, all of the article can be fed from the container and consumed completely without contaminating the hands except during the loading of article 8.

Figure 9:
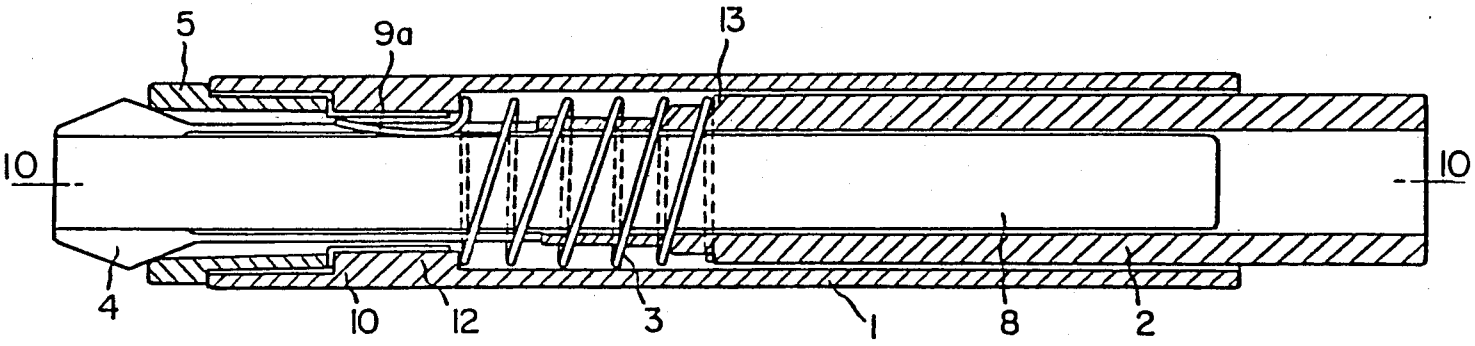
FIG. 9 shows a cross-sectional view of a container according to a third embodiment of this invention.
Figure 10:
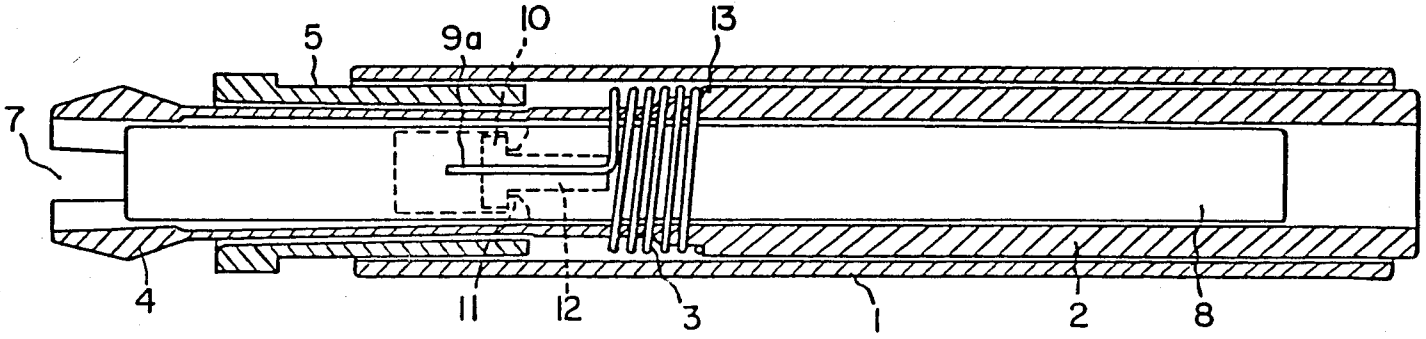
FIG. 10 shows a cross-sectional view cut along line X—X of FIG. 9 in an extended state.

Referring to the drawings, FIG. 9 shows a cross-sectional view of the container of another embodiment of this invention, while FIG. 10 shows a cross-sectional view cut along line X—X in FIG. 9 in an extended position.

Figure 3:
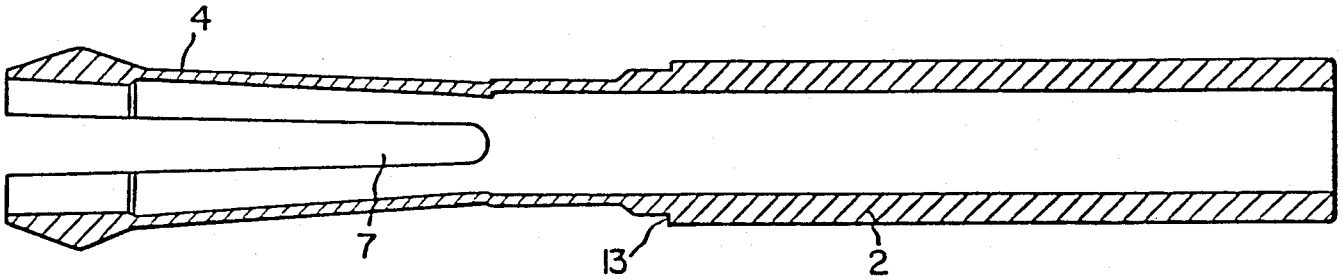
FIG. 3 shows a cross-sectional view of the inner sleeve according to the invention.

In FIGS. 9,10, 1 is an outer sleeve, and 2 is an inner sleeve inserted in outer sleeve 1. Chuck 4 is provided at the end of inner sleeve 2. In this example, chuck 4 is formed by two divided sections but may be three divided sections as shown in FIG. 3. A slit 7 is provided in chuck 4.

Chuck sleeve 5 engages the end of outer sleeve 1 and is inserted between chuck 4 and outer sleeve 1, with connecting bores 6 provided at the opposite sides and the rear part of chuck sleeve 5. A resilient member 9*a* and an insert 10 are provided on the outer sleeve 1 at the part in opposition to connecting bore 6. Resilient member 9*a* contacts bar shaped article 8 in the inner sleeve 2 through connecting bore 6 and split 7 in chuck 4. Insert 10 is slidably connected in connecting bore 6 (FIG. 11).

Figure 11:
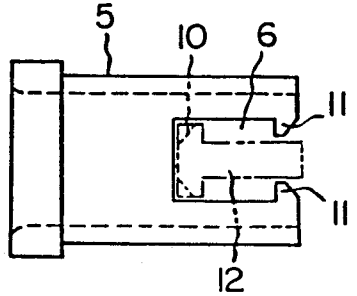
FIG. 11 shows a side view of the chuck sleeve according to the third embodiment of this invention.

As shown in FIG. 11, stopper 11 prevents the escape of insert 10 from connecting bore 6 when connected. Stopper 11 has chamfered edges to guide insert 10 into connecting bore 6. Insert 10 also has chamfered edges ease introduction into connecting bore 6.

Figure 12:
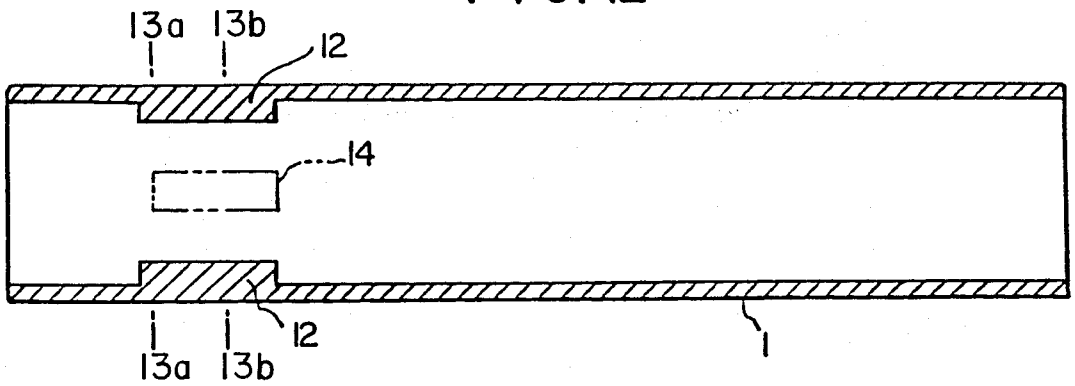
FIG. 12 shows a cross-sectional view of an outer sleeve according to a fourth embodiment of this invention.
Figure 13A:
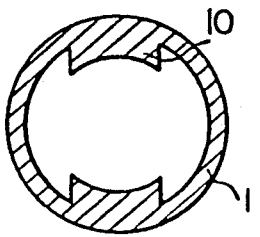
FIGS. 13*a*, 13*b* are cross-sectional views cut along lines XIII*a*—XIII*a* and XIII*b*—XIII*b* of FIG. 12, respectively.
Figure 13B:
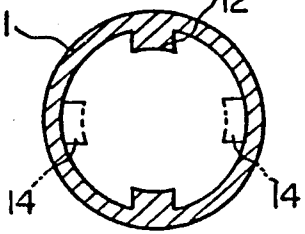

An elastic member 3 acting in an axial direction is provided between inner sleeve 2 and outer sleeve 1. In this fourth embodiment, the elastic member 3 is a thrust spring inserted between receiver 13 of inner sleeve 2 and receiver 12 of insert 10 of outer sleeve 1. If receiver 12 of insert 10 is not sufficient, a ring plate or additional receivers 14,14 as shown by dotted lines in FIGS. 12 and 13 are provided. Receivers 14,14 are at right angle positions to receivers 12,12. In this case, chuck sleeve 5 must have slits at positions corresponding to receivers 14,14.

Figure 14:
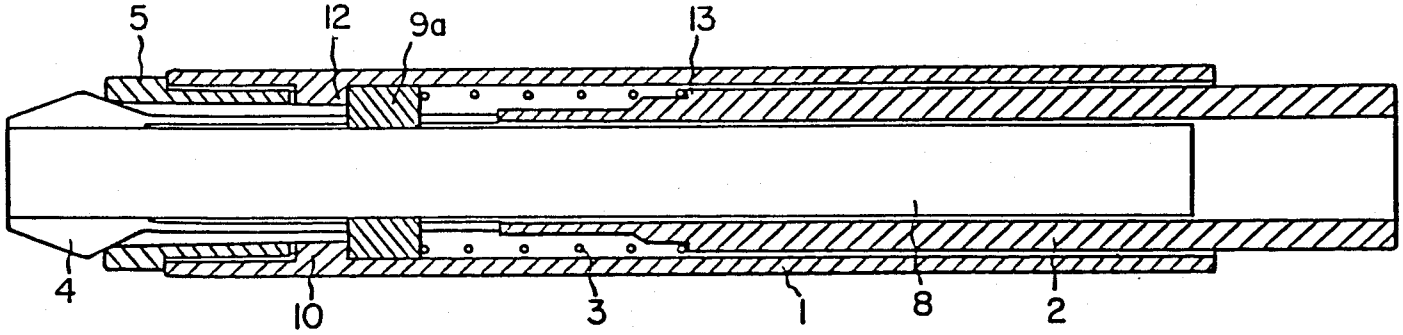
FIG. 14 shows a cross-sectional view of a fifth embodiment of this invention.

In this embodiment, resilient member 9*a* is integral with the elastic member 3 but it may be a flat spring or elastic member such as a gum insert provided between thrust spring 3 and spring receiver 12 as shown in FIG. 14.

In the fifth embodiment, an erasing gum, a pencil lead, a crayon, a pastel, or an eyebrow liner is used as the bar shaped article 8. The cross-sectional shape of article 8 may be circular, flat, square, or polygonal. Article 8 is inserted into inner sleeve 2 from the rear or front end and article 8 contacts resilient member 9*a*.

Loading article 8 in place is completed as explained previously but if loading is troublesome, a loading assist container may be used.

For extending or feeding article 8, outer sleeve 1 is held by hand and the rear end of inner sleeve 2 is pressed against spring 3, chuck 4 and article 8 advances a predetermined amount with chuck sleeve 5 until stopper 11 of connecting bore 6 abuts insert 10 which opens chuck 4. In this position, resilient member 9*a* holds article 8 in position to prevent escape or return to the container.

Next, inner sleeve 2 retracts by the resilient force of thrust spring 3 until chuck sleeve 5 abuts the end of outer sleeve 1. Then, chuck 4 withdraws into chuck sleeve 5 and closes holding article 8 together with resilient member 9*a*.

By repeating the pressing operation, article 8 can be advanced for use.

When the end of article 8 is worn out, it is withdrawn by repeating the pressing operation.

To retract the end of article 8 into the container, the rear end of inner sleeve 2 is pressed hard by an amount which is more than the usual force against resilient member 3, opening chuck 4. By pressing the end of article 8 against the frictional force of resilient member 9a contacting article 8 through connecting hole 6 and slit 7, it is retracted smoothly.

When all of article 8 is consumed, a new article 8 is loaded. Otherwise, another container may be used.

In the fifth embodiment shown in FIG. 14, projections 9a,9a on resilient members 16,16 contact article 8 by suitable force so that the advancing or retracting movement of article 8 is smoothly and firmly performed and variations in the diameter of article 8 can be accomodated.

As explained above, in this invention, bar shaped article 8 loaded in inner sleeve 2 can be advanced or fed a predetermined amount by repeating the pressing operation on the rear end of inner sleeve 2 with chuck sleeve 5 opening or closing chuck 4, and may be retracted by pressing the end of article 8 with chuck 4 open so that this invention provides a good compact handling container for feeding a bar shaped article.

The projections 9a,9a or resilient members 16,16 contact article 8 with a suitable force so that advancing or retracting article 8 is smoothly and firmly performed and variation in the diameter of article 8 can be accomodated.

Moreover the entire article can be advanced from the container and consumed without any residue contaminating the hand, except when loading an article 8. The number of parts with this invention is reduced so that cost is low and operation is less troublesome.

Figure 16:
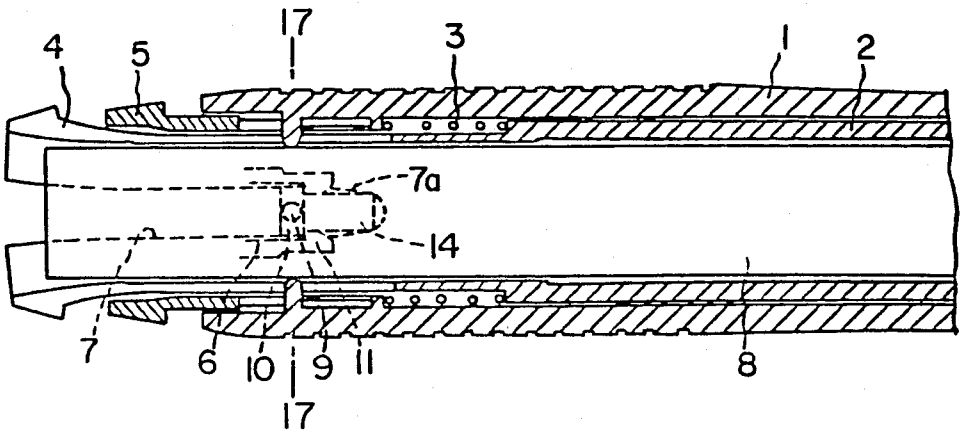
FIG. 16 shows a cross-sectional view cut along lines XVI—XVI in FIG. 15 in an extended state.
Figure 15:
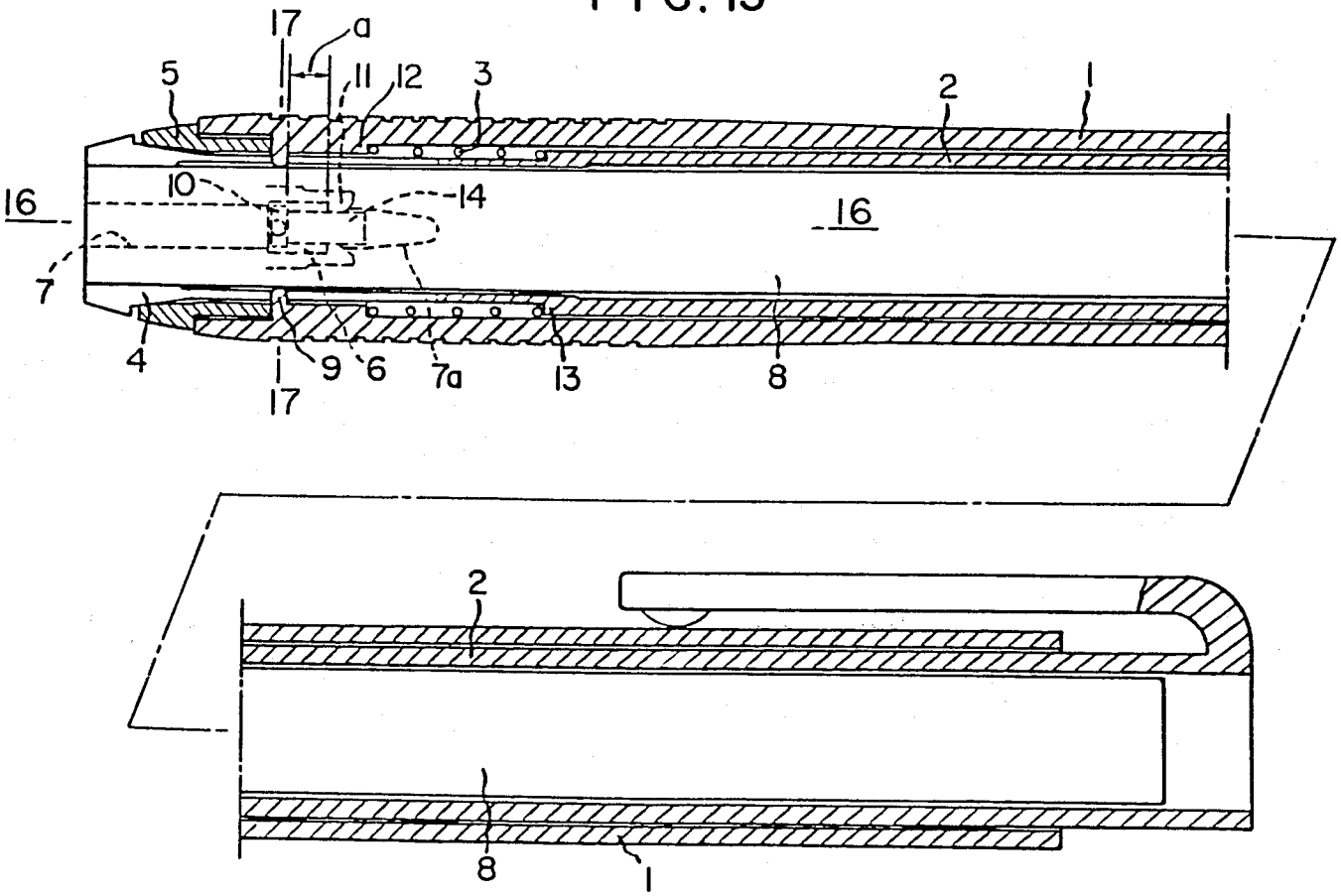
FIG. 15 shows a cross-sectional view of a container according to a sixth embodiment of this invention.
Figure 17:
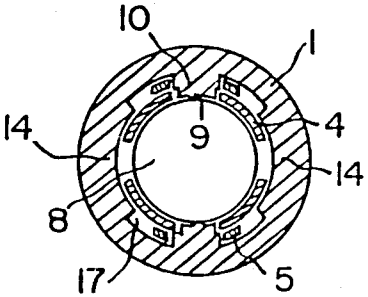
FIG. 17 shows a cross-sectional view of the inner sleeve cut along line XVII—XVII of FIG. 16 according to the invention.
Figure 19:
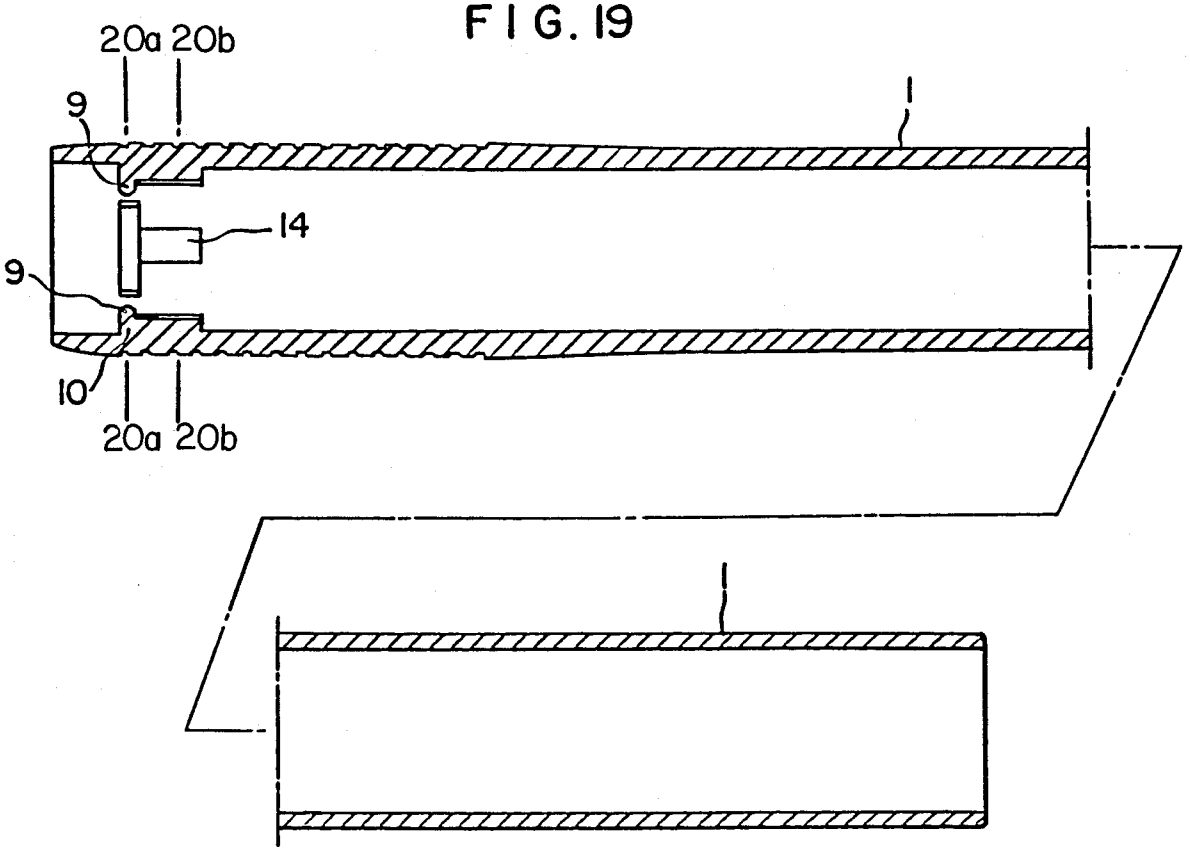
FIG. 19 shows a cross-sectional view of an outer sleeve according to a seventh embodiment of this invention.

Referring to drawings, FIG. 15 shows a cross-sectional view of a container according to a sixth embodiment of this invention, and FIG. 16 shows a cross-sectional view cut along XVI—XVI line in FIG. 15 in an extended position. FIG. 17 shows a cross-sectional view of the inner sleeve cut along line XVII—XVII of FIG. 16.

Figure 18:
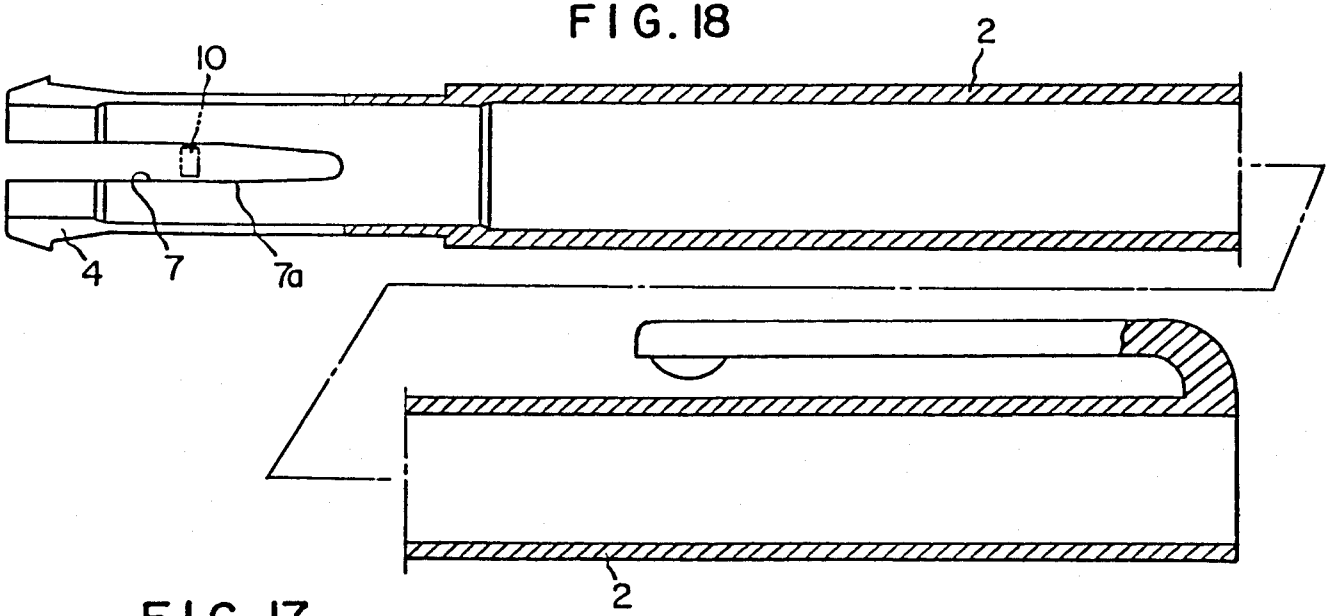
FIG. 18 shows a cross-sectional view of the inner sleeve according to the invention.
Figure 20B:
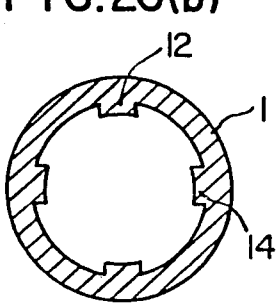
FIGS. 20*a* and 20*b* are cross-sectional views along lines XX*a*—XX*a* an XX*b*—XX*b* of FIG. 19 respectively.
Figure 20A:
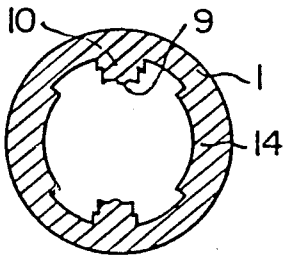

In FIGS. 15 and 16 inner sleeve 2 is inserted in outer sleeve 1. Chuck 4 is provided at the end of inner sleeve 2. In this example, chuck 4 is formed by two divided sections but may be three divided sections, as shown in FIG. 18. Slit 7 provided in chuck 4 has a narrower width at interior part 7a formed by tapered edges.

Chuck ring 5 engages the end of outer sleeve 1 inserted between chuck 4 and outer sleeve 1. Connecting holes 6 are provided at the opposite sides and the rear part of chuck ring 5. Projection 9 and slidably connected insert 10 are provided on outer sleeve 1 at the part opposing connecting hole 6. Projection 9 contacts bar shaped article 8 in inner sleeve 2 through the connecting hole 6 and split 7 in chuck 4. Stopper 11 has chamfered edges to guide insert 10 into connecting hole 6.

An elastic member 3 acting in an axial direction is provided between inner sleeve 2 and outer sleeve 1. In this sixth embodiment, elastic member 3 is a thrust spring inserted between receiver 13 of inner sleeve 2 and receiver 12 of insert 10 of outer sleeve 1. If receiver 12 of insert 10 is not sufficient, a ring plate or additional receivers 14,14 at a right angle position to receivers 12,12 are provided. In this case, chuck ring 5 must provide slits 17 at positions corresponding to additional receivers 14,14.

When article 8, is withdrawn into the container insert 10 is positioned in interior part 7a of slit 7 and slightly opens chuck 4 to lightly hold article 8.

In this embodiment, an erasing gum, a pencil lead, a crayon, a paste, or an eyebrow stick is used as bar shaped article 8. Article 8 is loaded into inner sleeve 2 from the rear or front end and the end of article 8 and abuts projection 9. In this embodiment, projection 9 is integral with outer sleeve 1 but may be another separated body such as a rubber or spring.

Loading article 8 is completed as explained previously but if the loading is troublesome, loading container may be used.

For feeding article 8, outer sleeve 1 is held by hand and the rear end of inner sleeve 2 is pressed against spring 3 by a small distance, causing chuck 4 and article 8 to be advanced by a predetermined amount with chuck ring 5 until stopper 11 of the connecting hole 6 abuts insert 10 causing chuck 4 to open. In this position, projection 9 engages article 8 holding it to prevent escape or retraction.

Next, inner sleeve 2 retracts from the resilient force of spring 3 until chuck ring 5 contacts the end of outer sleeve 1. Then, chuck 4 withdraws into chuck ring 5 and closes holding article together with projection 9.

By repeating the pressing operation, article 8 can be advanced incrementally for use.

When the end of article 8 is worn out, it may be withdrawn by a continuous pressing operation.

For retracting the end of article 8 into the container, rear end of inner sleeve 2 is pressed hard by an amount which is more than usual force against resilient member 3, opening chuck 4 widely. By pressing the end of article 8 against the frictional force between article 8 and the end of projection 9 but not encroaching through connecting hole 6 and slit 7, article 8 may be smoothly retracted. Interior part 7a of slit 7 of chuck 4 narrows so that chuck 4 is held slightly open by insert 10 or outer sleeve 1 in the retracted position. Thus chuck 4 does not encroach into article 8 even if article 8 is a soft resilient material and is left for a long time in an unused state, as chuck 4 will separate from article easily, allowing article 8 to be advanced.

When all of article 8 is consumed, a new article 8 is loaded. Otherwise, another container may be used.

Figure 21:
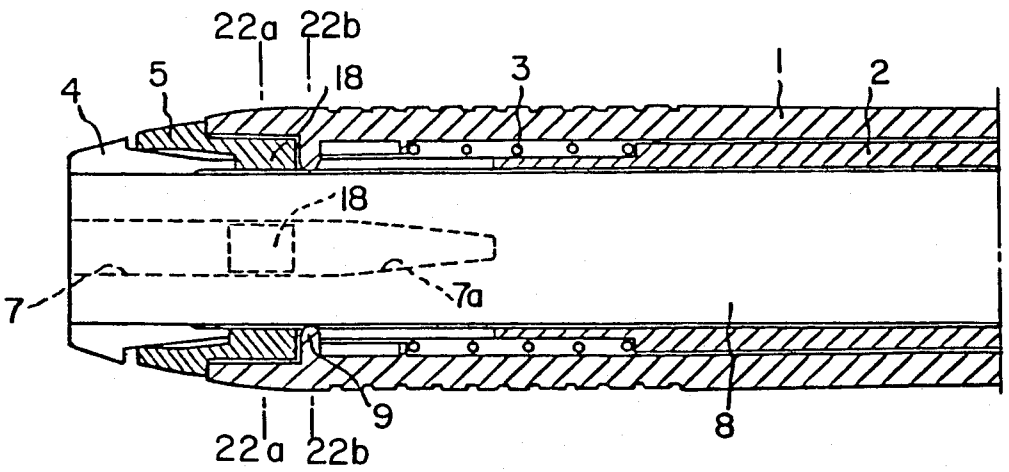
FIG. 21 shows a cross-sectional view of an eighth embodiment of according to the invention.
Figure 22B:
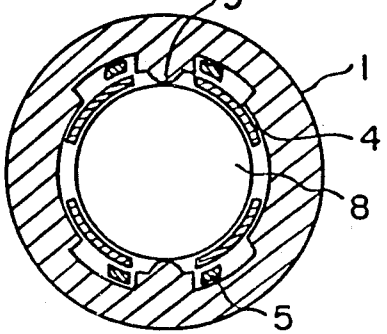
FIGS. 22*a*, 22*b* are cross-sectional views cut along lines XXII*a*—XXII*a* and XXII*b*—XXII*b* of FIG. 21 respectively.
Figure 22A:
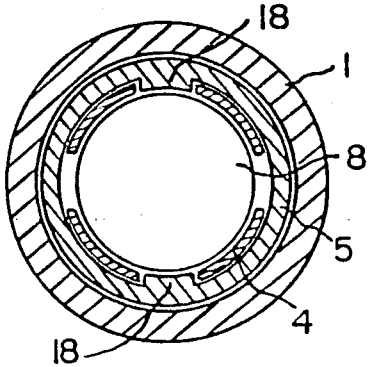

FIG. 21 shows a cross-sectional view of the eighth embodiment of this invention, and FIGS. 22a,22b are cross-sectional views along lines XXIIa—XXIIa and XXIIb—XXIIb of FIG. 21 respectively.

In the eighth embodiment, projection 18 extending into interior part 7a is provided adjacent the inner face of chuck ring 5. In this eighth embodiment, chuck 4 is opened slightly by engaging projection 18 extending into interior part 7a in the retracted position, so that chuck 4 does not encroach into article 8 as much as the first embodiment even if article 8 is a soft, resilient material and left for a long time in an unused state. Chuck 4 separates from the article 8 easily, allowing article 8 to be advanced.

As explained above, in this invention, chuck 4 is opened by insert 10 or projection 18 entering into narrower interior part 7a in the retracted position, preventing chuck 4 from encroaching into article 8 a much as the first embodiment even if the article 8 is a soft, resilient material and left unused for a long time. Chuck 4 separates from article 8 easily, allowing article 8 to be advanced.

Moreover all of article 8 can be fed from the container and consumed without residual contaminating the hands except when loading article 8.

This invention is not to be limited by the embodiment shown in the drawings and described in the description, which is given by way of example and not of limitation, but only in accordance with the scope of the appended claims.

I claim:

1. A container for feeding bar shaped articles comprising:

an outer sleeve (1);

an inner sleeve (2) insertable in said outer sleeve (1);

an axially biasing elastic member (3) between said inner sleeve (2) and said outer sleeve (1) biasing said inner sleeve (2) against said outer sleeve (1);

chuck means (4) at one end of said inner sleeve (2), said chuck means having a split (7);

said split (7), in said chuck means (4) narrowing at an interior portion so that said chuck means (4) is forced open when the end of said inner sleeve (2) opposite said chuck means (4) is pressed a chuck ring (5) between said chuck means (4) and said outer sleeve (1);

a projection on an interior surface of said chuck ring (5) engaging said split (7) in said chuck means (4);

a connecting hole (6) at a rear portion of said chuck ring (5) away from said chuck means (4);

an insert (10) on an interior surface of said outer sleeve (1) slidably connected in said connecting hole (6); and a projection (9) on said insert (10) engaging a bar shaped article inserted in said inner sleeve.

2. A container for feeding bar shaped articles comprising:

an outer sleeve (1);

an inner sleeve (2), slidably inserted in said outer sleeve (1);

an axially biasing elastic member (3) between said inner and outer sleeves (1,2) biasing said inner sleeve (20) against said outer sleeve (1);

chuck means (4) at one end of said inner sleeve (20) having split (7);

said split (7) in said chuck means (4) narrowing at an interior portion so that said chuck means (4) is forced open when the end of said inner sleeve (2) opposite said chuck means (4) is pressed;

a chuck ring (5) engaging the end of said outer sleeve (1) being inserted between said chuck means (4) and said outer sleeve (1);

a projection (18) on an interior surface of said chuck ring (5) engaging said split (7) in said chuck means (4);

a connecting bore (6) at a rear portion of said chuck sleeve (5);

a resilient projecting member (9) on the interior of said outer sleeve (1);

an insert (10) on the interior of said outer sleeve (1);

said resilient projecting member (9) and said insert (10) being in opposition to said connecting bore (6) in said chuck sleeve (5) so that said resilient projecting member (9) will contact a bar shaped article in said inner sleeve (2);

said insert (10) being slidably connected in said connecting bore.

* * * * *